US006325071B1

(12) United States Patent
Butcher

(10) Patent No.: US 6,325,071 B1
(45) Date of Patent: Dec. 4, 2001

(54) DUAL BLADE MASCARA APPLICATION SYSTEM

(75) Inventor: John Butcher, Scotch Plains, NJ (US)

(73) Assignee: G.H.B. Enterprises, Scotch Plains, NJ (US)

( * ) Notice: Subject to any disclaimer, the term of this patent is extended or adjusted under 35 U.S.C. 154(b) by 0 days.

(21) Appl. No.: 09/506,659

(22) Filed: Feb. 17, 2000

(51) Int. Cl.[7] ..... A45D 40/26; A45D 40/24
(52) U.S. Cl. ..... 132/218; 132/317; 132/320
(58) Field of Search ..... 132/218, 216, 132/217, 320, 317, 313; 401/129

(56) References Cited

U.S. PATENT DOCUMENTS

| | | | | |
|---|---|---|---|---|
| 1,527,964 | * | 2/1925 | Patino | 132/217 |
| 1,666,116 | | 4/1928 | Bunnell . | |
| 1,795,482 | | 3/1931 | Ehmann . | |
| 2,022,896 | | 12/1935 | Nathans . | |
| 2,136,779 | | 11/1938 | Bednar . | |
| 2,252,551 | | 8/1941 | Brollier et al. . | |
| 2,323,595 | | 7/1943 | Hanisch . | |
| 2,392,694 | * | 1/1946 | Rector | 132/217 |
| 2,411,519 | * | 11/1946 | Byron | 132/217 |
| 2,444,937 | | 7/1948 | Marcellus . | |
| 2,463,611 | | 3/1949 | Green et al. . | |
| 2,635,611 | | 4/1953 | Marcellus . | |
| 2,675,004 | | 4/1954 | Bablon . | |
| 2,788,537 | | 4/1957 | Greenberg . | |
| 3,016,059 | | 1/1962 | Hutton | 132/218 |
| 3,339,561 | * | 9/1967 | Brickner | 132/217 |
| 4,458,701 | | 7/1984 | Holland | 132/218 |
| 4,784,165 | * | 11/1988 | Stein | 132/217 |
| 5,007,442 | | 4/1991 | Hirzel | 132/218 |
| 5,611,361 | | 3/1997 | Leone | 132/218 |

* cited by examiner

*Primary Examiner*—John J. Wilson
*Assistant Examiner*—Robyn Kieu Doan
(74) *Attorney, Agent, or Firm*—Mathews, Collins, Shepherd & Gould, P.A.

(57) ABSTRACT

The present invention relates to a dual bladed mascara application system having a dual bladed mascara applicator which is received in a cylindrical product container. A bottom blade has a channel formed adjacent a front edge thereof for receiving mascara. A top blade has a deflector rib positioned opposite the channel. The bottom blade can include teeth on the front edge. A wiper has a disc shape with two apertures to accept the applicator blades. A wiper housing receives the wiper and is rotatable in the product container. After use, the wiper housing can be locked to the product container.

15 Claims, 3 Drawing Sheets

DUAL BLADE MASCARA APPLICATION SYSTEM

BACKGROUND OF THE INVENTION

1. Field of the Invention

The invention relates to an applicator for applying mascara to eyelashes in which the eyelashes are inserted between dual blades for immersing the eyelashes in a mascara product and are withdrawn from the blades through teeth of comb for separation of the eyelashes.

2. Related Art

The application of mascara to the eyelashes is a time consuming and imprecise process. Conventional applicators are typically a single brush and rely largely on the artistry and dexterity of the user for the quality of the result. In effect mascara is dabbed at the eyelashes using a spiral brush containing variable amounts of product. The eyelashes tend to flex away from the brush. Accordingly, it is difficult to coat them adequately with a few strokes unless excessive amounts of product are acquired on the brush. The conventional applicator has the disadvantage of clumping of the mascara which requires subsequent correction by using an eyelash comb or similar implement to separate the eyelashes.

There have been a number of attempts at improving the process of applying mascara. U.S. Pat. No. 5,007,442 describes a tong system having a pair of rods with an applicator at the lower ends thereof The applicators can be a comb or a brush. The tong system traps the eyelashes between the applicators. This system has the limitation of being difficult to maneuver safely around the eye and will tend to pull out the eyelashes due to the confining nature of the entrapment. Also, since this system is a brush-based system, the product pick-up and application of the product are extremely variable.

U.S. Pat. No. 5,611,361 describes a mascara application system having two arms to trap the eyelashes. An applicator brush or comb is attached to each arm. The arms are not intended to close but simply to rotate against either side of the eyelashes. This patent has the shortcoming that positioning is difficult and brush application consistency is variable.

U.S. Pat. No. 4,458,701 describes a tong system using two non-spiral brushes. The brushes are made of a resilient material such that the brushes may receive the eyelashes therebetween. The resilience of the material keeps the brush holding arms of the tongs apart when not in use. A user presses the arms together to catch the eyelashes between the brushes to apply mascara. This system has the advantage of being less likely to pull out eyelashes. However, the design has limitations related to the wiping of the brushes, product retention in the brush and sealing of the product in the base container. All of the above-described references are cumbersome to use and fail to provide reliable, even coating of the eyelashes and the possibility of eyelash combing or separation.

It is desirable to provide an improved mascara applicator for providing even coating of the mascara and separation of the eyelashes.

SUMMARY OF THE INVENTION

The present invention relates to a dual bladed mascara application system having a dual bladed mascara applicator which is received in a cylindrical product container. A bottom blade has a channel formed adjacent a front edge thereof for receiving mascara. A top blade has a deflector rib positioned opposite the channel. The bottom blade can include teeth on the front edge. A wiper has a disc shape with two apertures to accept the applicator blades. A wiper housing receives the wiper and is rotatable in the product container. After use, the wiper housing can be locked to the product container.

The invention functions by immersing the eyelashes in mascara between the channel of the bottom blade and the reflector rib. The eyelashes are subsequently withdrawn from the applicator through the teeth of the bottom blade. This action ensures even coating and separation of the eyelashes. The wiper and container system provides a constant fill volume with cleanly wiped blades until the container is virtually empty. The advantages of this system over conventional systems are the speed and consistency of application, the quality of the result, and the minimal wastage of mascara product. The invention will be more fully described by reference to the following drawings.

DETAILED DESCRIPTION

Figure 1:
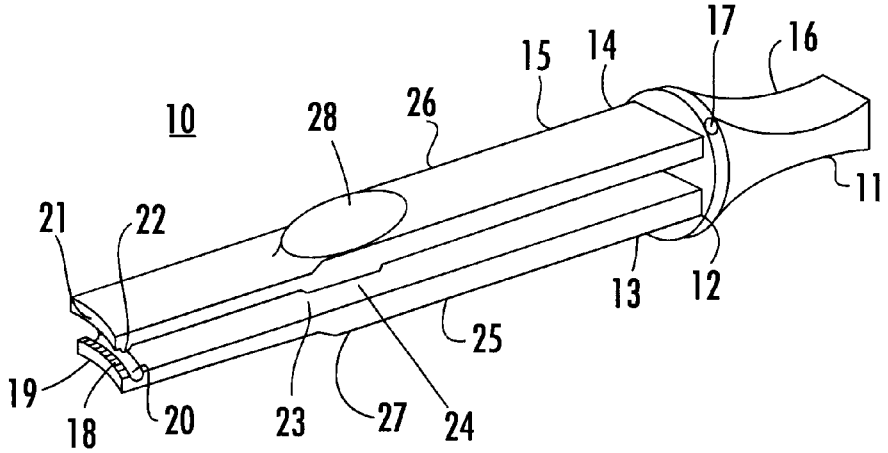
FIG. 1 is a front and side perspective view of a dual blade mascara applicator in accordance with the teaching of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 illustrates dual blade mascara applicator 10 in accordance with the teaching of the present invention. End 12 of bottom blade 13 and end 14 of top blade 15 are attached to applicator cap 16. Bottom blade 13, top blade 15 and applicator cap 16 can be formed integrally. For example, bottom blade 13, top blade 15 and applicator cap 16 can be formed of molded plastic for allowing bottom blade 13 and top blade 15 to be compressed together and return to their original position when pressure is released. A suitable materials for bottom blade 13, top blade 15 and applicator cap 16 are polypropylene or nylon. Portion 11 of applicator cap can be concave for providing an improved grip of applicator cap 16. Lug 17 is formed on applicator cap 16.

Teeth 18 are formed in front edge 19 of bottom blade 13. Channel 20 is formed in bottom blade 13 adjacent front edge 19. Top blade 15 includes deflector rib 22 positioned adjacent front edge 21. Deflector rib 22 is positioned opposite channel 20 of bottom blade 13. Front edge 19 and front edge 21 can have a inwardly curved shape for following the shape of the eye.

Inner stop 23 is formed in middle portion 24 of top blade 15. Inner stop 23 prevents bottom blade 13 from fully closing adjacent top blade 15 when pressure is applied to outside surface 25 of bottom blade 13 and outside surface 26 of top blade 15. Outer stop 27 is formed on outside surface 25 of bottom blade 13. Outer stop 28 is formed on outside surface 26 of top blade 15.

Figure 2B:
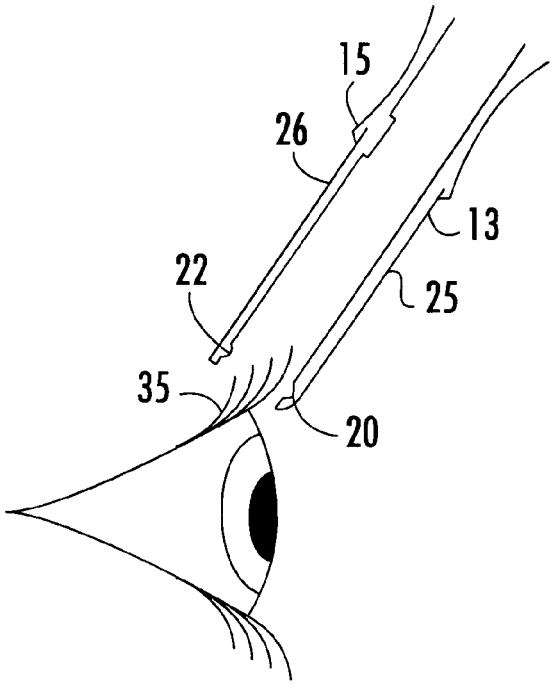
FIG. 2B is a front and side elevational view of the mascara applicator during use.
Figure 2A:
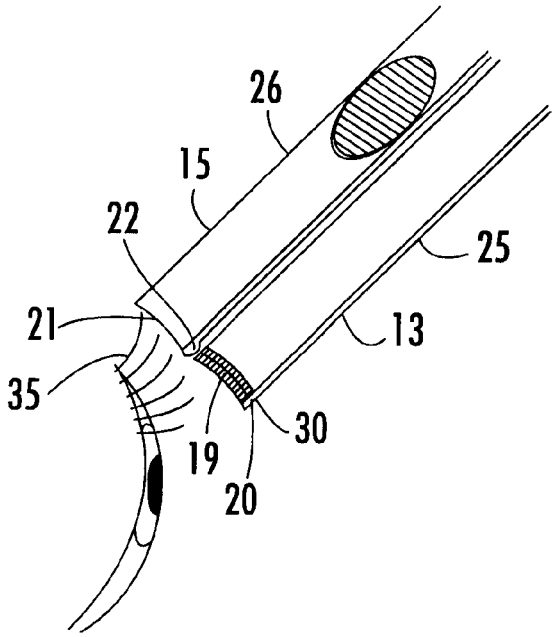
FIG. 2A is a side view of the mascara applicator during use.

FIGS. 2A and 2B illustrate dual blade mascara applicator 10 during operation. Product 30 is received in channel 20 of bottom blade 13. For example, product 30 can be mascara or an alternative eye makeup. Front edge 19 of bottom blade 13 and front edge 21 of top blade 15 are applied adjacent eyelashes 35, thereby providing good visibility when using a mirror by keeping the hand and dual blade mascara applicator 10 from obstructing the line of sight and avoiding obstruction with the bridge of the nose. Bottom blade 13 is positioned under eye lashes 35 and top blade 15 is positioned above eyelashes 35. Bottom blade 13 and top blade 15 are compressed towards one another. For example, a forefinger of a user can apply pressure to outer surface 26 of top blade 15 and a thumb of the user can apply pressure to outer surface 25 of bottom blade 13.

Upon compression of bottom blade 13 toward top blade 15, eyelashes 35 are pressed between channel 20 and deflector rib 22, as shown in FIG. 2B. Deflector rib 22 presses eyelashes 35 down into channel 20 for submerging eyelashes 35 in product 30 located in channel 20. Dual blade mascara applicator 10 is moved away from eyelashes 35 while bottom blade 13 and top blade 15 remain under compression for coating the full length of eyelashes 35. By this motion, teeth 18 of bottom blade 13 separate eyelashes 35 for removing clumping of product 30. For example, this motion can be repeated about three times for eyelashes 35 of each eye. Dual blade mascara applicator 10 can be held in either hand. Stop 24 prevents bottom blade 13 and top blade 15 from grabbing or pulling lashes during mascara application.

Figure 3:
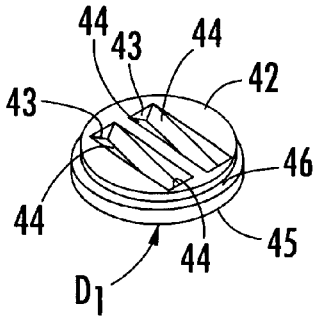
FIG. 3 is a front elevational view of a wiper.

FIGS. 3–7 illustrate wiper and container system 40 for receiving mascara applicator 10 and applying product 30 thereto to form a dual blade mascara application system 41. Wiper 42 has a circular disc shape. Wiper 42 includes a pair of apertures 43 for receiving bottom blade 13 and top blade 15, as shown in FIG. 3. Apertures 43 are formed of a pair of inclined surfaces 44. Inclined surfaces 44 form a "V" shape to prevent wiper 42 from deflecting in channel 20 of lower blade 13, when inserting bottom blade 13 into aperture 43 thereby retaining mascara 30 product in channel 20. Wiper 42 includes outer flange 45 around outer diameter $D_1$. Recess 46 is formed in a portion of outer flange 45. Preferably, wiper 42 is formed of a flexible material such as synthetic rubber.

Figure 4:
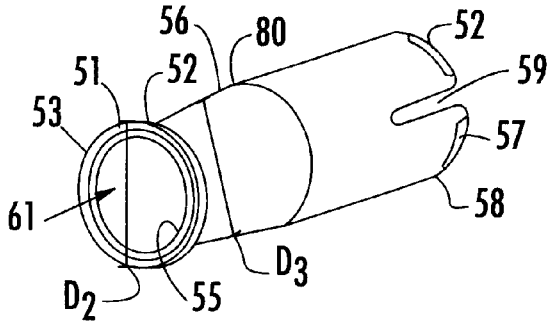
FIG. 4 is a front and side perspective view of a wiper housing.
Figure 6:
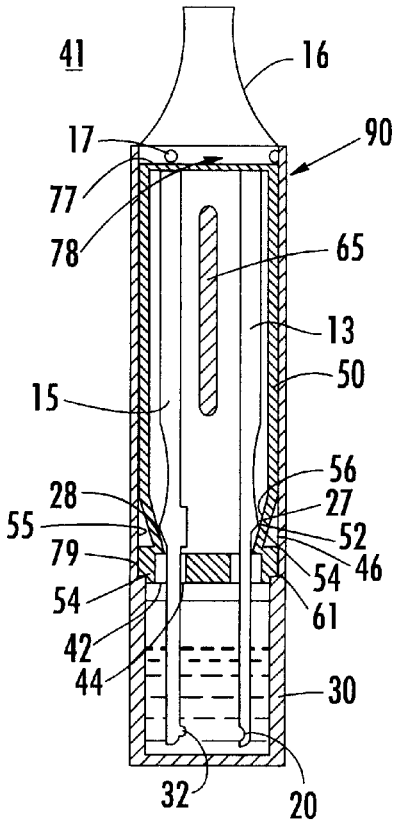
FIG. 6 is a cross-sectional cut-away view of assembly of a mascara applicator system.

Wiper housing 50 has a hollow tubular shape, as shown in FIG. 4. Outer surface 51 of end 52 includes outer flange 53. End 52 has an outer diameter $D_2$. Antirotation rib 54 is formed on inner surface 55, as shown in FIG. 6. Middle portion 56 has an inclined shape formed of a reduced inner diameter $D_3$. Lugs 57 are formed in end 58 of wiper housing 50. Groove 59 is formed in end 58. Channel 61 is formed on inner surface 55 of end 52. Wiper housing 50 includes separator wall 65 attached to inner surface 66 of wiper housing 50, as shown in FIG. 6.

Figure 5A:
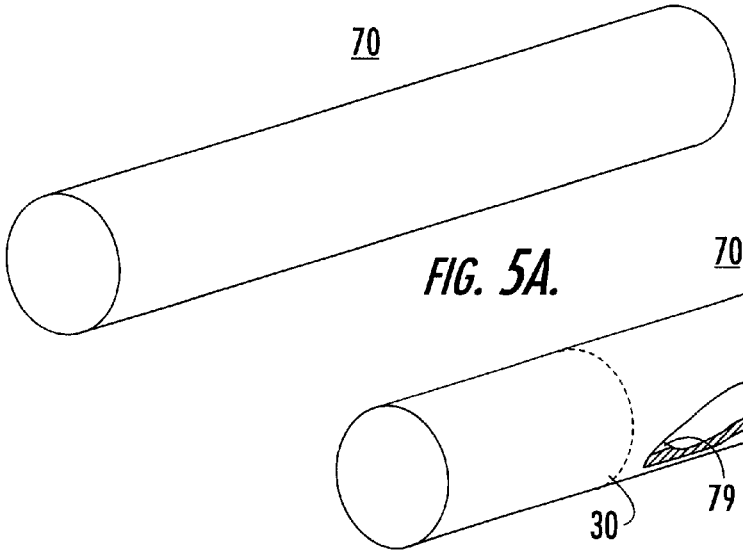
FIG. 5A is a side elevational view of a mascara container.
Figure 5B:
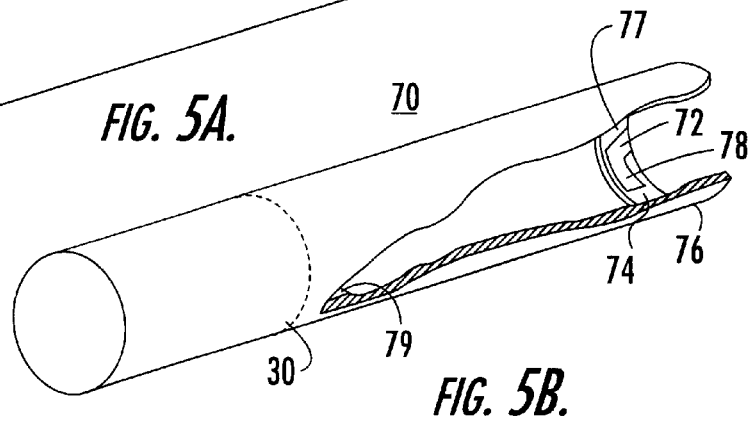
FIG. 5B is a cut-away view of the mascara container.

Product container 70 has an elongated tubular shape for receiving wiper housing 50, as shown in FIG. 5. A portion of product container 70 is filled with product 30. For example, about ⅓ of product container 70 can be filled with product, 30. Channel 72 is formed on inner surface 74 of end 76. For example, channel 72 can have a J shape having upper portion 77 and lower portion 78. Lower portion 78 extends around the inner circumference of inner surface 74. Inner lip 79 is formed on inner surface 74. Groove 80 extends around the inner circumference of inner surface 74 below lower portion 78.

During assembly of dual blade mascara application system 41, wiper 42 is placed in wiper housing 50 by flexing wiper 42 and maneuvering outer flange 45 of wiper 42 into channel 61 of wiper housing 50. Outer diameter $D_1$ of wiper 42 is substantially the same as the inner diameter $D_2$ of wiper housing 50. After insertion of wiper 42 into wiper housing 50, wiper 42 is rotated until antirotation rib 54 of wiper housing is engaged in recess 46 of wiper 42.

Assembled wiper unit 42 and wiper housing 50 are received in product container 70, as shown in FIG. 6. Groove 59 allows wiper housing 50 to flex during insertion into product container 70. Wiper housing 50 is inserted until outer flange 53 of end 52 contacts inner lip 79. Assembled wiper unit 42, wiper housing 50 and product container 70 form wiper and container system 40. Applicator cap 16 is received in wiper and container system 40. Applicator cap 16 is inserted until outer stop 27 and outer stop 28 contact middle portion 56 of wiper housing 50. Bottom blade 13 is positioned on one side of separator wall 65 and top blade 15 is positioned on the other side of separator wall 65 for separating and guiding bottom blade 13 and top blade 15.

Immersion of applicator cap 16 into wiper and container system 40, fills channel 20 with product 30. Upon withdrawal of applicator cap 16 from wiper and container system 40, excess product coating bottom blade 13 and top blade 15 is removed by inclined surface 44 of wiper 42.

After use, applicator cap 16 is again inserted in product container 70. Lugs 57 of wiper housing 50 are received in groove 80 of product container 70. Lug 17 of applicator cap 16 is received in upper portion 77 of channel 72. Lug 17 is rotated into lower portion 78 of channel 72 by pressing and turning applicator cap 16 to lock applicator cap 16 to product container 70. Outer flange 53 of wiper housing 50 compresses to press against middle portion 56 of wiper housing 50 to prevent migration of product 30 around wiper housing 50. Locking of applicator cap 16 into product container 70 prevents drying out of product 30 contained in product container 70.

It is to be understood that the above-described embodiments are illustrative of only a few of the many possible specific embodiments which can represent applications of the principles of the invention. Numerous and varied other arrangements can be readily devised in accordance with these principles by those skilled in the art without departing from the spirit and scope of the invention.

I claim:

1. A dual-blade mascara application system comprising:

an applicator cap;

a bottom blade extending from said applicator cap, said bottom blade having a channel formed adjacent a front edge thereof, said channel extending laterally in said bottom blade;

a top blade extending from said applicator cap, said top blade having a deflector rib positioned opposite of said channel; and a product container adapted for receiving said bottom blade and said top blade.

2. The system of claim 1 further comprising:

a wiper having a disc shape and pair of apertures therein adapted for receiving said bottom blade and said top blade; and a wiper housing having an elongated tubular shape, said wiper adapted to engage said wiper housing.

3. The system of claim 2 wherein said apertures a reformed of a pair of inclined surfaces.

4. The system of claim 2 where in said wiper housing includes a channel formed on a first end thereof and said wiper has an outer flange, said outer flange of said wiper being received in said channel.

5. The system of claim 4 wherein said wiper has a recess and said wiper housing has an antirotation rib, wherein said antirotation rib is adapted to engage said recess.

6. The system of claim 2 wherein said wiper housing has a separator wall extending from the inner surface of said wiper housing.

7. The system of claim 2 wherein said wiper housing has a plurality of lugs of the outside surface thereof and said lugs are received in a groove of said product container.

8. The system of claim 2 wherein said wiper housing has a middle portion with an inclined surface and an outer step is formed on an outside surface of said bottom blade and said top blade, and said outer step contacts said inclined surface to stop insertion of said applicator cap.

9. The system of claim 2 wherein said product container has a lip on an inner surface thereof and said wiper housing contacts said lip.

10. The system of claim 2 wherein said applicator cap has a lug on the outside surface thereof and said lug is received in a channel formed on the inner surface of said product container.

11. The system of claim 2 wherein said wiper is formed of thermoplastics material of synthetic rubber or natural rubber.

12. The system of claim 1 wherein said bottom blade has a curved front edge and a plurality of teeth formed in said front edge.

13. The system of claim 1 wherein said top blade has an inner stop formed on an inner surface of a middle portion of said top blade.

14. The system of claim 1 wherein said bottom blade, said top blade and said applicator cap are integrally formed.

15. The system of claim 1 wherein said bottom blade, said top blade and said applicator cap are formed of polypropylene or nylon.

* * * * *